US007156104B2

(12) United States Patent
Kennedy et al.

(10) Patent No.: US 7,156,104 B2
(45) **Date of Patent: *Jan. 2, 2007**

(54) HAIR COLORING APPARATUS AND METHODS

(75) Inventors: Melvin R. Kennedy, Lantana, FL (US); Jose Longoria, Miami, FL (US); Robert G. Robbins, Boca Raton, FL (US)

(73) Assignees: Kennedy/Matsumoto Design LLC, Lantana, FL (US); Longoria Design LLC, Miami, FL (US); Spectrum Associates LLC, Boca Raton, FL (US)

( * ) Notice: Subject to any disclaimer, the term of this patent is extended or adjusted under 35 U.S.C. 154(b) by 533 days.

This patent is subject to a terminal disclaimer.

(21) Appl. No.: 10/781,380

(22) Filed: Feb. 18, 2004

(65) Prior Publication Data

US 2004/0211437 A1 Oct. 28, 2004

Related U.S. Application Data

(63) Continuation-in-part of application No. 10/370,262, filed on Feb. 19, 2003, now Pat. No. 6,848,452.

(30) Foreign Application Priority Data

May 14, 2003 (WO) ..... PCT/US03/15057

(51) Int. Cl.
*A61K 7/13* (2006.01)

(52) U.S. Cl. ..... 132/208; 132/270

(58) Field of Classification Search ..... 132/208, 132/119.1, 270, 108, 110, 119, 120; 401/9, 401/10, 268

See application file for complete search history.

(56) References Cited

U.S. PATENT DOCUMENTS

| | | | |
|---|---|---|---|
| 3,195,537 | A | 7/1965 | Blasi |
| 3,491,774 | A | 1/1970 | Carbone |
| 3,864,780 | A | 2/1975 | Watkins |
| 4,211,247 | A | 7/1980 | Morganroth |
| 4,602,651 | A | 7/1986 | Roppatte, Jr. |
| 4,958,647 | A | 9/1990 | Busch et al. |
| 5,622,192 | A | 4/1997 | Chiou |
| 5,647,841 | A | 7/1997 | Groenewold et al. |
| 5,784,744 | A | 7/1998 | Toran |
| 5,937,865 | A | 8/1999 | Dhaliwal |
| 5,972,043 | A | 10/1999 | Galvan et al. |
| 6,012,462 | A | 1/2000 | Schmittou |
| 6,022,163 | A | 2/2000 | Asfur |

(Continued)

FOREIGN PATENT DOCUMENTS

CN 2320094 Y 6/1999

(Continued)

*Primary Examiner*—John J. Wilson
*Assistant Examiner*—Robyn Doan
(74) *Attorney, Agent, or Firm*—Akerman Senterfitt

(57) ABSTRACT

A hair coloring applicator (10) for applying a hair coloring material to one or more strands of hair using a rotating brush (12). The hair coloring applicator may include a housing (24) and a supply of hair coloring material (44) positioned so as to contact the brush (12). The housing (24) may include at least one opening for receiving at least one strand of hair and placing the at least one strand of hair in contact with the brush (12). The hair coloring applicator (10) may simultaneously apply one or more colors of hair coloring material (44) to strands of hair. The brush (12) may include bristles, a napped material, and/or an absorbent material.

34 Claims, 15 Drawing Sheets

U.S. PATENT DOCUMENTS

| | | | |
|---|---|---|---|
| 6,050,271 | A | 4/2000 | Spencer |
| 6,053,177 | A | 4/2000 | Sofer |
| 6,062,230 | A | 5/2000 | Kajgana |
| 6,145,513 | A | 11/2000 | Chu et al. |
| 6,170,108 | B1 | 1/2001 | Knight |
| 6,357,449 | B1 | 3/2002 | Chu et al. |
| 6,460,546 | B1 | 10/2002 | Sofer |
| 6,513,534 | B1 | 2/2003 | Sofer et al. |
| 6,626,599 | B1 | 9/2003 | De Laforcade |
| 6,746,165 | B1 | 6/2004 | de Laforcade |
| 2002/0148484 | A1 | 10/2002 | Chu et al. |
| 2003/0024544 | A1 | 2/2003 | Thiebaut |

FOREIGN PATENT DOCUMENTS

| | | | |
|---|---|---|---|
| GB | 808762 | A | 2/1959 |
| GB | 819778 | A | 9/1959 |
| JP | 1244708 | | 9/1989 |
| JP | 2002-345543 | | 12/2002 |

HAIR COLORING APPARATUS AND METHODS

CROSS-REFERENCE TO RELATED APPLICATIONS

This application is a continuation-in-part of application Ser. No. 10/370,262, filed Feb. 19, 2003 now U.S. Pat. No. 6,848,452, and also claims priority from PCT/US03/15057, filed May 14, 2003.

FIELD OF THE INVENTION

This invention is directed generally to hair coloring, and more particularly to systems and methods for applying hair coloring materials to hair.

BACKGROUND

Hair coloring is undertaken to change or cover the color of hair for many different reasons. For instance, hair is often colored to cover hair that has turned gray, to lighten or change the shade of hair, or to highlight or lowlight hair. The hair coloring procedures used to generate these results are often markedly different and use different coloring materials. The hair coloring materials may be dyes that may or may not be easily washed from the colored hair with conventional shampoo and water, or other materials.

For as many reasons exist for a person to color their hair, there exist nearly as many systems for applying color to hair. For instance, hair may be colored by hair professionals in salons using liquid dyes. The dyes are often thoroughly mixed with the hair by a technician or stylist. This process may also be completed at home using dyes purchased at retail stores. A system for applying color to hair is shown in U.S. Pat. No. 6,053,177, which depicts a cartridge coupled to a plurality of hollow dispensing tines. The tines resemble the bristles of a common hair brush. The cartridge includes a piston that forces a hair dye through the tines to contact hair while the cartridge is passed through hair as though brushing hair using a conventional hair brush. While these systems provide methods for applying dye to hair, most of these systems do not facilitate easy to use methods of applying dye to select portions of hair on a person's head. In addition, most conventional systems involve undesirable contact of a person's hands with hair dyes, which can contain irritants.

Thus, a need exists for a hair coloring apparatus capable of overcoming these and other disadvantages of the conventional systems.

SUMMARY OF THE INVENTION

The invention relates to a hair coloring applicator including a housing, and a brush which rotates relative to the housing. A holder for hair coloring material is positioned such that hair coloring material held by the holder can contact the brush. The housing includes at least one opening for receiving at least one strand of hair and placing the at least one strand of hair in contact with the brush.

The brush may be generally annular. The brush may include a support and bristles, napped material, and/or an absorbent material arranged on the support. In one arrangement, the brush may include a support and bristles or napped material arranged on the support so that the bristle or nap of the brush is angled away from a direction of rotation of the brush.

In one embodiment, the brush may include a support and at least one brush element mounted to the support and a biasing mechanism that biases the at least one brush element away from the support into contact with the supply of hair coloring material. At least two of the brush elements may be mounted to the support. The brush element may include a mounting surface movable relative to the support, and the brush element may include napped material or absorbent material provided on the mounting surface.

The holder for hair coloring material may be provided at a first location relative to the housing. The applicator may also include a motor having a shaft, the brush being driven rotationally in response to rotation of the shaft. A deflector may be movably coupled relative to the housing at a second location which is spaced from the first location so as to contact the brush at the second location. The deflector may define a hair channel in the housing at the second location between an inlet into the housing and an outlet from the housing. Rotation of the brush may cause hair coloring material from a supply held in the holder at the first location to be transferred to any hair disposed in the hair channel at the second location.

In one embodiment, a device that applies a hair coloring material to the brush may be included. A biasing mechanism may be provided that biases a hair coloring material dispensing cartridge positioned in the housing towards the brush to keep a hair coloring material contained in the dispensing cartridge in contact with the brush. The biasing mechanism may be a spring, a threaded rod or a compressible material. In another embodiment, the device for applying a hair coloring material to the brush may include a plurality of guides that position a hair coloring material dispensing cartridge so that the brush contacts the hair coloring material contained in the dispensing cartridge. In another embodiment, the device may be formed from at least one aperture in the housing for receiving a hair coloring material and allowing the hair coloring material to contact the brush. A flange may be included, coupled to the housing proximate to the aperture and configured to support a container capable of storing hair coloring material.

The applicator may include a deflector movably coupled to the body for placing at least one strand of hair in contact with the applicator. The deflector may include a substantially flat inside surface. The deflector may be biased toward the brush. An operating mechanism may be included that operates both the deflector and a motor that drives the brush. The operating mechanism may be biased to a position whereby the deflector is closed and the motor is off.

The brush of the hair coloring applicator may be rotated using a motor. A gear assembly may be configured to couple the shaft of the motor to the brush. A power source may be included, which may be one or more batteries.

The hair coloring material holder may include a container releasably coupled to the housing. The container may be squeezable. The device may include a plunger.

A braking mechanism may be included for substantially preventing the at least one strand of hair from traveling backwards through the at least one opening. The braking mechanism may include at least one lever arm coupled to the housing. The braking mechanism may include at least one off-centered wheel. In one arrangement, the braking mechanism may include at least two juxtaposed wheels.

In one arrangement, the brush may be rotatably mounted in the housing. The hair coloring material holder may be positioned such that hair coloring material held by the holder can contact the brush within the housing.

The applicator may be used for a variety of purposes. For instance, and not by way of limitation, the hair coloring applicator may be used to add streaks of bright colors to hair for a fun effect. The applicator may also be used to color a natural streak of hair on a person that is not the same color as the rest of the hair. For example, the applicator may be used to add color to a streak of gray hair so that the gray streak blends in with the surrounding hair. In another example, the hair coloring applicator may be used to apply a highlight, such as a blonde streak, to a head of hair. In yet another example, the applicator may be used to add streaks of multiple colors to a head of hair. These and other uses will become apparent upon review of the enclosed drawings and detailed description below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

This invention is directed to a hair coloring applicator 10, as shown in FIGS. 1–18. Hair coloring applicator 10 may have numerous configurations capable of applying a hair coloring material 44 to one or more strands of hair. The strands of hair may be human hair found growing from or connected to a human head, strands of hair connected to a wig, hair connected to a device for holding hair, or other hair. Hair coloring applicator is not limited to coloring only human hair, but may be used to color dolls, animal hair, filaments, and other items.

Hair coloring applicator 10 may have one or more brushes 12. The brush 12 may be generally annular. The term "brush" when used in connection with the applicator described herein can be understood to include brushes, combs, picks, teasers, and any other arrangement having bristles or a napped material thereon, and also includes an applicator having pads of absorbent or semi-absorbent material such as a foam or sponge material. The term "bristles" can be understood to include tines, bristles, hairs, filaments, quills, and any similar arrangement that can apply coloring material to hair, although the invention is not limited in this regard. The term "napped material" can be understood to include napped, villous, piled, velvet, plush or tufted fabric or material, or any other suitable material that can apply coloring material to hair, although the invention is not limited in this regard. The term "absorbent material" can be understood to include foam, sponge, woolen, matted or felted material, or any other suitable material that can apply coloring material to hair, although the invention is not limited in this regard.

Figure 3:
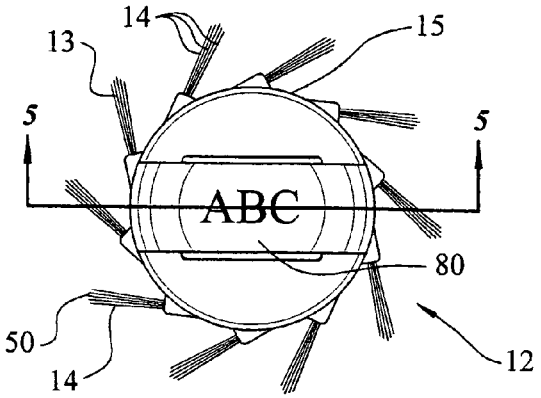
FIG. 3 is a top view of a brush of the hair coloring applicator.
Figure 4:
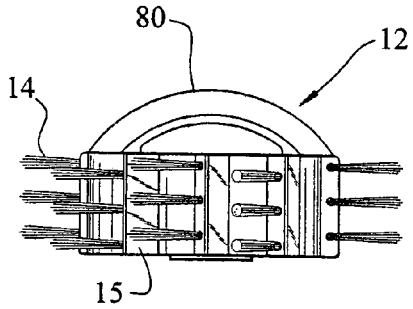
FIG. 4 is a side view of the brush of FIG. 3.
Figure 5:
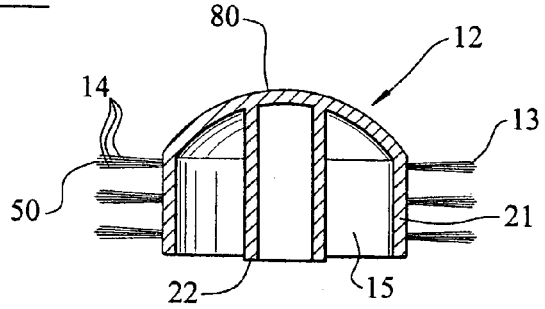
FIG. 5 is a sectional view of the brush of FIG. 3 taken at line 5—5.
Figure 25:
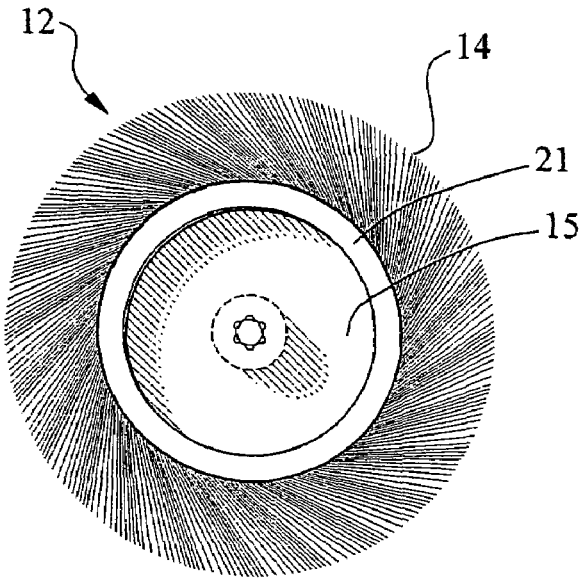
FIG. 25 is a top view of another embodiment of a brush of a hair coloring applicator.

The brush 12 may include a plurality of tufts 13, each of which may be formed of a plurality of bristles 14. The tufts 13 may be provided on a rotatable support 15 that may include a mounting surface 21 extending around the circumference of a hub 22, as shown in FIGS. 3–5. The hub 22 may be circular or may have any other suitable shape. The plurality of tufts 13 may together form a generally annular brush. In an alternative arrangement shown in FIGS. 25 and 26, the support 15 may have a plurality of bristles 14 extending around the circumference of mounting surface 21 in a continuous arrangement to form a generally annular brush 12.

The brush 12 may be rotatably mounted to a body 16 using a shaft 18. Bristles 14 may extend from brush 12 and may be angled away from the direction of rotation 20 of the brush 12. In at least one embodiment, bristles 14 may be positioned at an angle between about 20 degrees and about 60 degrees relative to lines that are generally tangent to the generally circular hub 22 forming the brush 12 at points where the bristles 14 connect to the hub 22. In the illustrated example, the angle for the bristles 14 is about 30 degrees relative to a tangent to the hub. It will be appreciated that an embodiment having a relatively large hub 22 with relatively short bristles 14 may have the bristles connected to the hub at a different angle to an embodiment having a relatively small hub 22 with relatively long bristles 14, but the same angle may be created by these embodiments at the tip of the bristles 14. Thus, it may be appropriate in some embodiments to measure the angle at the tip of the bristles. One method of measuring the angle at the tip of the bristles 14 is to extend a radial line from the center of hub 22 through the tip of the bristles 14, and then measure the angle made by a line projecting from the tip of the bristles 14 relative to this radial line. Preferably, the angle between the radial line and the bristles is between about 20 degrees and about 60 degrees, most preferably about 30 degrees. The bristles 14 may be formed from any acceptable material, such as, but not limited to, natural bristles and synthetic materials, such as synthetic fibers, nylon, plastics, wire and other materials.

Figure 1:
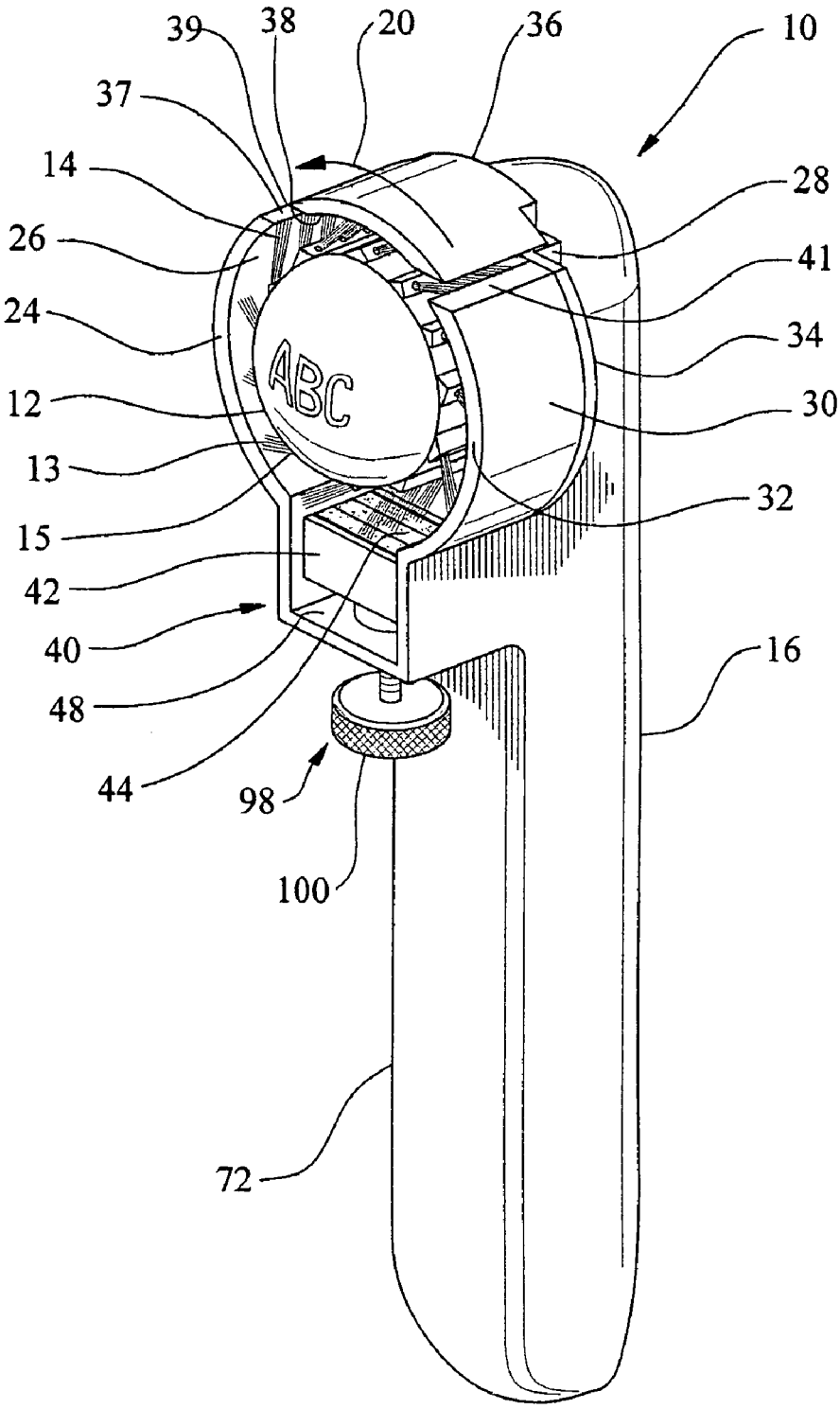
FIG. 1 is a perspective view of a hair coloring applicator.
Figure 2:
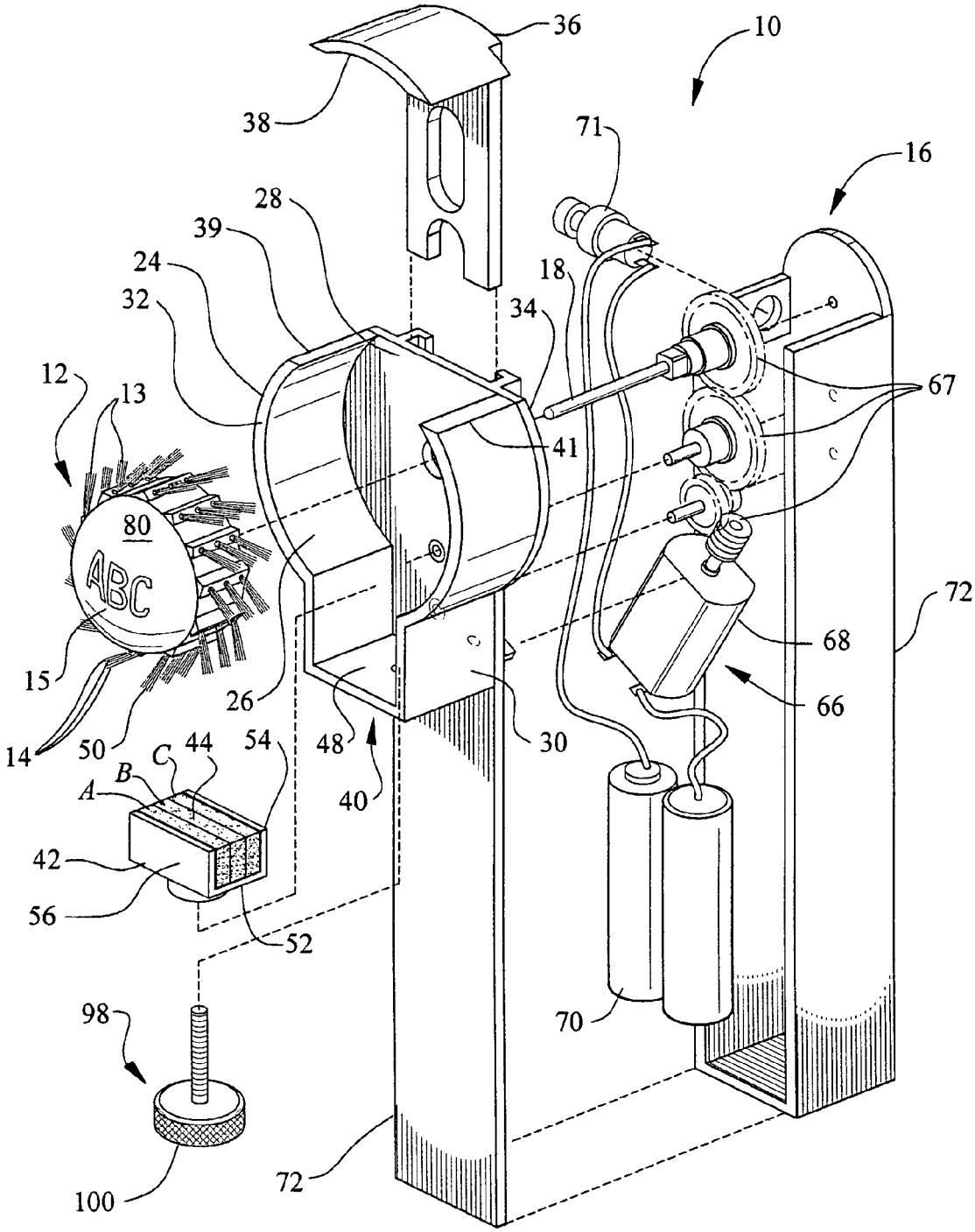
FIG. 2 is an exploded view of the hair coloring applicator of FIG. 1.

In at least one embodiment, the bristles 14 are configured to be contained in a housing 24. Bristles 14 extend from hub 22 of brush 12 toward an inside surface 26 of housing 24. Housing 24 may contain at least a portion of the brush 12. In one embodiment, housing 24 is substantially circular, as shown in FIGS. 1 and 2. Housing 24 may cover a substantial portion of brush 12. The thickness of housing 24 is preferably at least slightly wider than a thickness of hub 22 of brush 12, to avoid unnecessary wear to housing 24 and brush 12. However, hair coloring applicator 10 is not limited to this arrangement. Housing 24 may substantially prevent inadvertent contact with bristles 14 while brush 12 is rotating and thereby prevent hair coloring material 44 from inadvertently contacting unwanted areas such as a user's face, hands, arm, clothing, furniture, or other objects.

Housing 24 may also include at least one opening 28 for receiving at least one strand of hair. Opening 28 may be formed on an outside surface 30 of housing 24. Opening 28 may extend from a front surface 32 of housing 24 partially towards a back surface 34 of housing 24, or may contact the bottom surface. In another embodiment, the opening 28 may extend from front surface 32 to back surface 34. Opening 28 may have any configuration capable of receiving one or more strands of hair. Opening 28 may be generally circular, rectangular, as shown in FIG. 2, or any other shape.

Opening 28 may be covered with a deflector 36. Deflector 36 may, in effect, define a hair channel 37. Hair channel 37 may have an inlet 39 and an outlet 41, whereby one or more strands of hair may be feed into hair coloring applicator 10, contact bristles 14, and exit through the outlet. Deflector 36 may be movably coupled to housing 24. In one embodiment, deflector 36 is slidably coupled to housing 24 and is capable of moving from a closed position, where the deflector may contact bristles 14 to an open position, where the deflector may be removed, or substantially removed, from contact with the bristles. In this configuration, deflector 36 may be biased towards the closed position in which the deflector is in contact with bristles 14. Alternatively, the deflector 36 may be biased towards the open position and away from being in contact with bristles 14. In another embodiment, deflector 36 may be rotatably coupled to housing 24 so that the deflector may be rotated between a closed position, and an open position. In at least one embodiment, deflector 36 may have a generally flat inside surface 38. In yet another embodiment, the inside surface 38 may be curved to correspond with the radius of curvature of bristles 14 of brush 12 or may be curved away from the bristles. The inside surface 38 of the deflector 36 may impart a straightening action to the hair as it passes through the hair coloring applicator, which can aid in the application of color to some textures of hair. In some embodiments, a heating element may aid in straightening of the hair.

Hair coloring applicator 10 may also include a device 40 for applying hair coloring material to bristles 14 of brush 12. Device 40 may be any device capable of placing a hair coloring material 44 in contact with bristles 14 of brush 12. In at least one embodiment, device 40 is a cavity formed in housing 24 for containing a cartridge 42. Cartridge 42 may or may not be disposable. Cartridge 42 may be configured in numerous manners. In one embodiment, cartridge 42 may be formed from a base 52, and side walls 54 and 56.

Cartridge 42 may contain hair coloring material 44 having one or more colors, which may include, but are not limited to, red, yellow, pink, orange, green, blue, purple, brown, black, any combinations or shades thereof, or others. Hair coloring material 44 having different colors may be separated into distinct sections in cartridge 42, which may enable the creation of color stripes in strands of hair. Alternatively, hair coloring material 44 may be swirled or otherwise mixed together.

Figure 22:
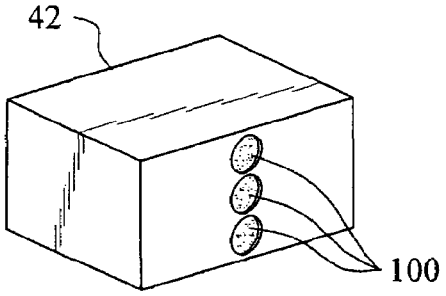
FIG. 22 is an alternative embodiment of a cartridge for containing a hair coloring material.
Figure 23:
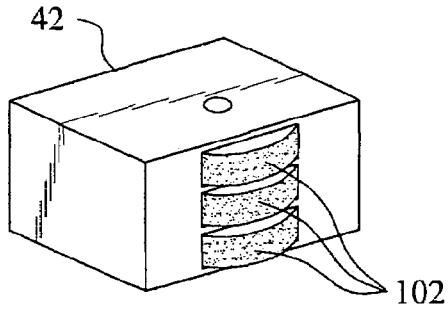
FIG. 23 is another alternative embodiment of a cartridge for containing a hair coloring material.
Figure 24:
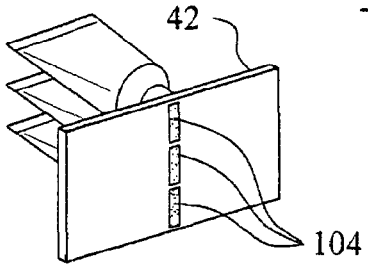
FIG. 24 is another alternative embodiment of a cartridge for containing a hair coloring material.

The cartridge 42 may be configured to contain solid or liquid hair coloring materials 44, or both. For instance, as shown in FIG. 2, cartridge 42 may be configured to receive individual sticks of pastels. The pastels may be installed in cartridge 42 by an end user or during a manufacturing process. Cartridge 42 may also be configured, as shown in FIG. 22, to include a plurality of openings 100. Each opening 100 may be connected to a cavity for containing a liquid hair coloring material 44. In another embodiment, as shown in FIG. 23, cartridge 42 may include one or more rollers 102 for dispensing one or more hair coloring materials. Each roller 102 may or may no be coupled to a separate cavity. In yet another embodiment, as shown in FIG. 24, cartridge 42 may include one or more containers 104, which may or may not be squeezable.

Hair coloring material 44 may be any material that is colored. Hair coloring material 44 may include, but is not limited to, pastels, powder, paint, hair coloring paste, hair mascara, liquid dyes or colorants, chalk, glitter, or other appropriate material. The pastels may be used in varying degrees of hardness, such as, but not limited to, regular, soft and very soft, and in at least one embodiment, soft pastels are preferred. Hair coloring material 44 may be a permanent dye or may be nonpermanent and temporary in duration. In at least one embodiment, hair coloring material 44 may also be easily washed out of the hair. Hair coloring material 44 may include various scents.

Figure 17:
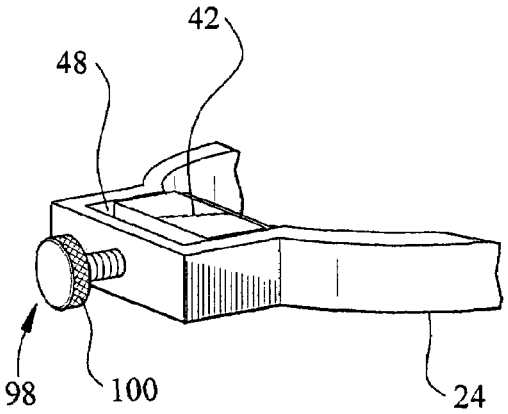
FIG. 17 is a partial perspective view of a device for applying a biasing mechanism in a cavity in a housing of the hair coloring applicator for placing a hair coloring material contained in a cartridge in contact with a brush.
Figure 18:
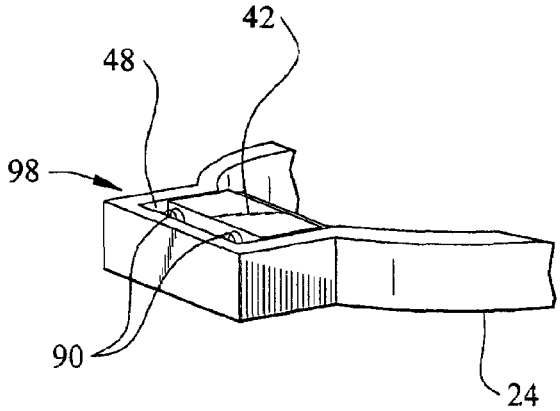
FIG. 18 is another embodiment of the biasing mechanism of FIG. 17.
Figure 19:
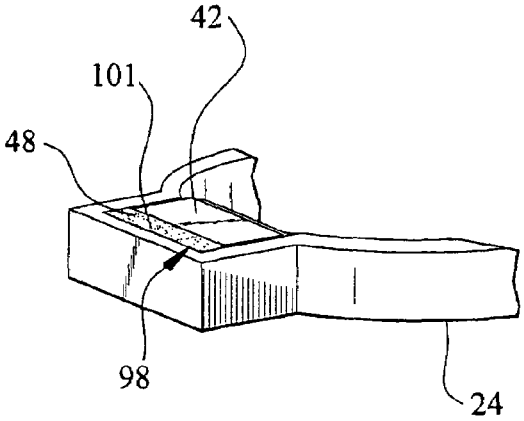
FIG. 19 is another embodiment of the biasing mechanism of FIG. 17.
Figure 20:
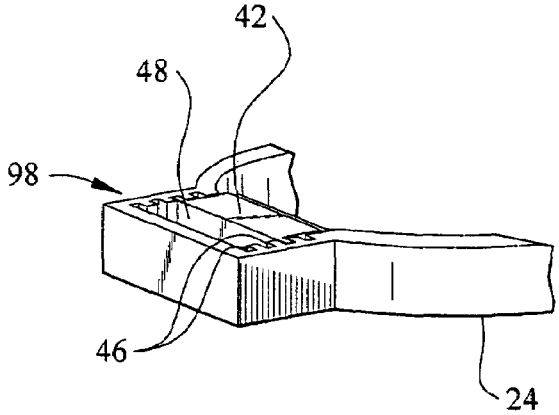
FIG. 20 is another embodiment of the biasing mechanism of FIG. 17.

Cartridge 42 may be held in position in cavity 48 with any appropriate biasing mechanism 98. For instance, as shown in FIGS. 1 and 2, cartridge 42 may be sized to fit tightly with the interior walls of cavity 48 or may be sized slightly smaller than the distance between the interior walls of cavity 48. In this configuration, cartridge 42 may fit in cavity 48 and may have little space to move out of position. Cartridge 42 may be advanced towards bristles 14 of brush 12 using any number of appropriate materials. For instance, and not by way of limitation, cartridge 42 may be biased towards brush 12 using biasing mechanism 98, which may be, but is not limited to, one or more springs 90, as shown in FIG. 18, a threaded rod 100, as shown in FIGS. 1, 2, and 17, a compressible material 101, such as foam, as shown in FIG. 19, guides 46, as shown in FIG. 20, or other appropriate device.

Figure 13:
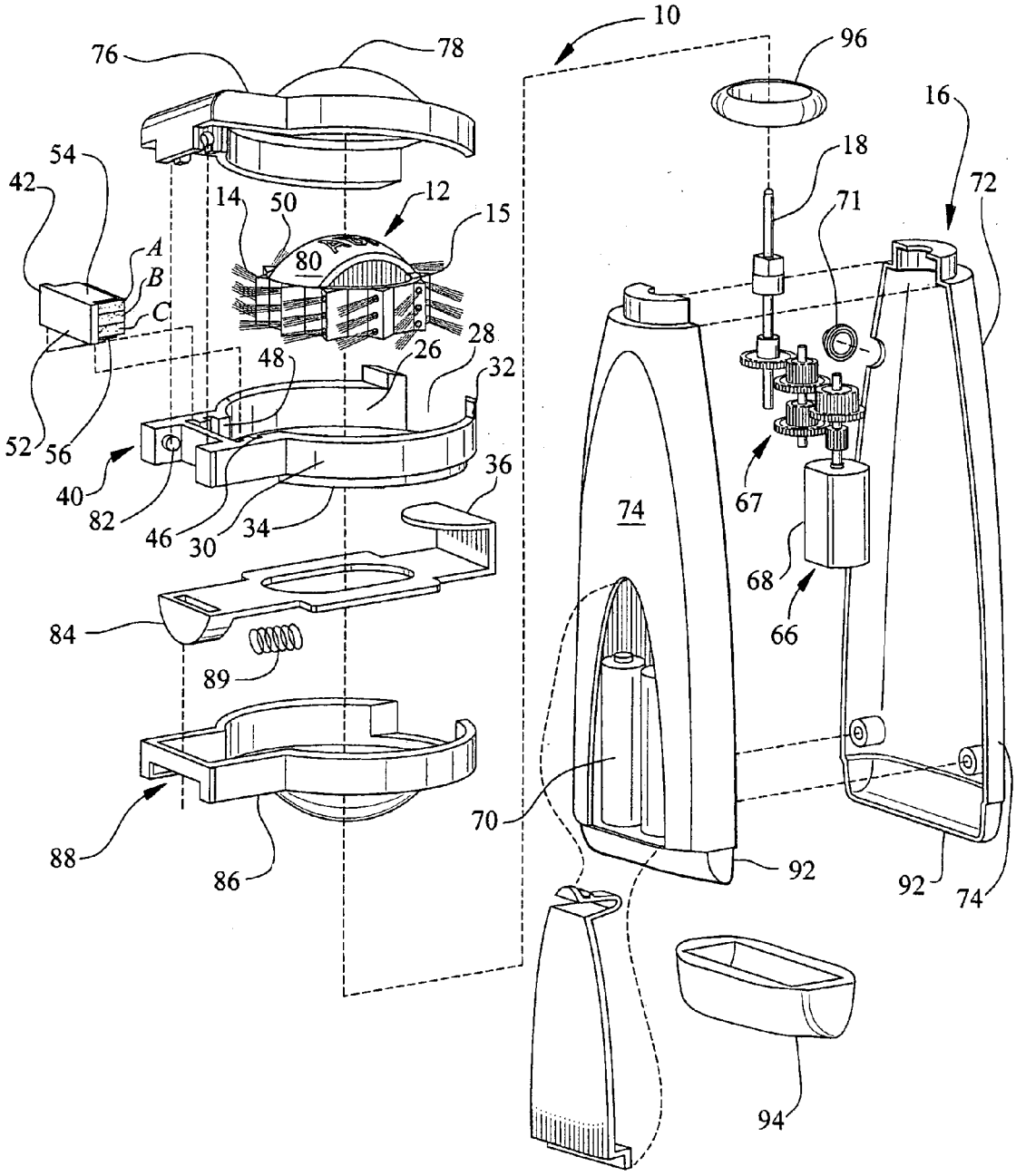
FIG. 13 is an exploded perspective view of another embodiment of a hair coloring applicator.

In another embodiment, the cartridge 42 may be held in position using one or more guides 46 in cavity 48, as shown in FIG. 13. Guides 46 enable cartridge 42 to be placed in a position relative to tips 50 of bristles 14 so that the tips contact a top surface of the hair coloring material 44 contained in cartridge 42. As bristles 14 remove hair coloring material 44 from cartridge 42 and apply it to the hair, the cartridge may be repositioned in cavity 48 by inserting the cartridge into guides 46 closer to brush 12 so that tips 50 of the bristles once again contact hair coloring material 44 in cartridge 42.

Figure 6:
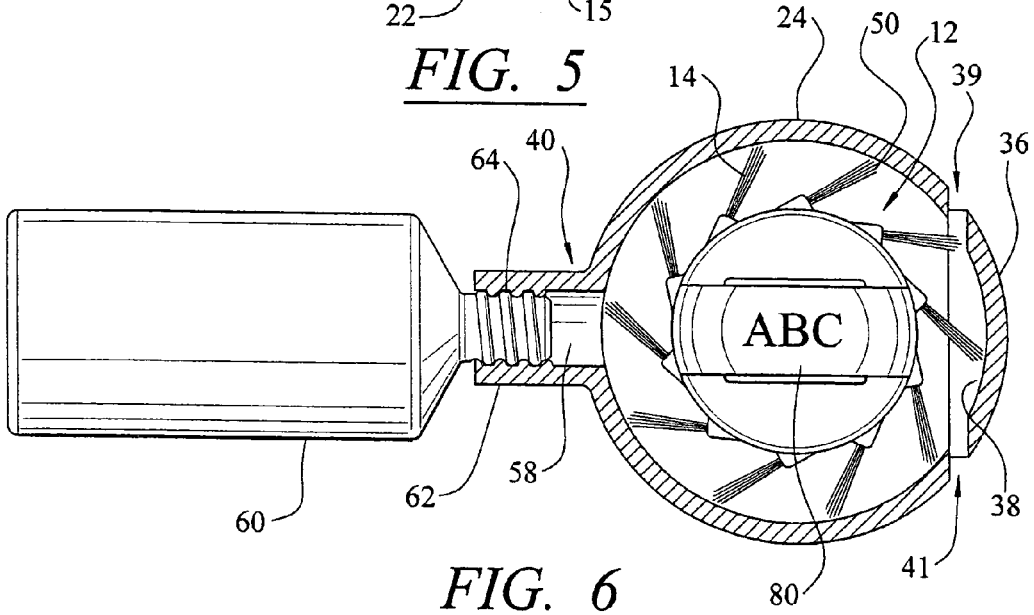
FIG. 6 is part sectional view of another embodiment of a hair coloring applicator.

Device 40 may also include at least one aperture 58 for enabling hair coloring material 44 to contact tips 50 of bristles 14. Aperture 58 may be positioned in any location in housing 24. In one embodiment, as shown in FIG. 6, aperture 58 may be positioned in a side wall of housing 24. Aperture 58 may be sized and configured to allow hair coloring material 44 to pass through the aperture and contact bristles 14. In one embodiment, aperture 58 may be configured to receive one or more containers 60. Containers 60 may be disposable bottles. Container 60 may also be squeezable, manually or through use of a motorized system, to enable the hair coloring material contained in the container to be expelled. Container 60 may include a plunger for expelling a hair coloring material 44 contained in the container from the container. Container 60 may also be configured to contain two or more hair coloring materials 44 having different colors. Container 60 may include separate compartments for storing the different hair coloring materials. A flange 62 may be coupled to housing 24 proximate to aperture 58 to assist in supporting container 60. In one embodiment, the flange 62 may include an attachment mechanism 64 which may be, but is not limited to, threads, ribs, clamps, interference fittings, or other attachment devices.

Hair coloring applicator 10 may also include a drive device 66 coupled to brush 12 for rotating the brush. Drive device 66 may be a crank assembly operable by a user turning the crank. In at least one other embodiment, drive device 66 may be a motor 68. Motor 68 may be an electric motor or other appropriate motor. Motor 68 may be coupled to shaft 18 through one or more gears 67. Gear 67 may be used to increase or decrease the rotational speed of brush 12 relative to motor 68. Gear 67 may positioned in any position, such as generally vertical or generally horizontal. Motor 68 may be in communication with a power supply 70. The power supply 70 may be a battery, as shown in FIGS. 2 and 13, or any device coupled to a conventional power supply system, such as a wall outlet. If power supply 70 is a battery, the battery may or may not be rechargeable. Power supply 70 or drive device 66 may be contained in a handle 72 or coupled to the hair coloring applicator in another manner. Motor 68 may be controlled using a switch 71. Switch 71 may be any acceptable switch for turning motor 68 on and off.

Handle 72 may form a portion of body 16. Handle 72 may or may not have an ergonomically configured outside surface 74. Outside surface 74 may or may not be textured, such as, but not limited to, a knurled surface. Handle 72 may include a removable lid providing access to the one or more batteries in embodiments of hair coloring applicator 10 using batteries. Handle 72 may be formed from one or more colors.

Figure 7:
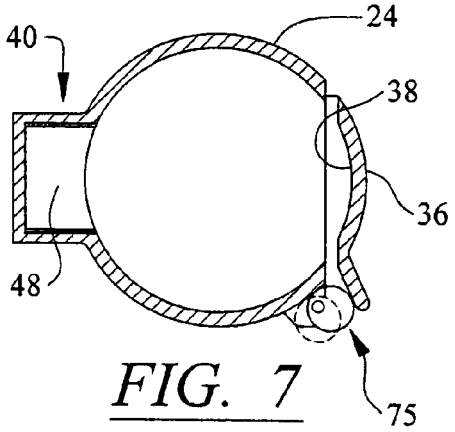
FIG. 7 is a top view of a braking mechanism usable with a hair coloring applicator.
Figure 8:
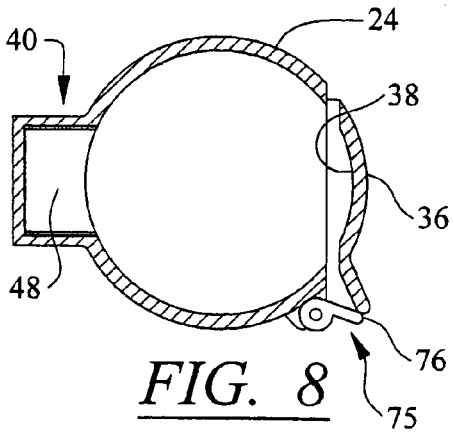
FIG. 8 is another embodiment of the braking mechanism of FIG. 7.
Figure 9:
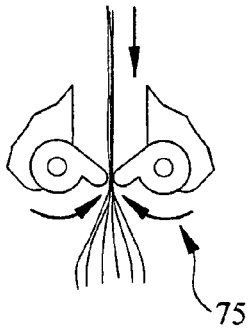
FIG. 9 is another embodiment of the braking mechanism of FIG. 7.
Figure 10:
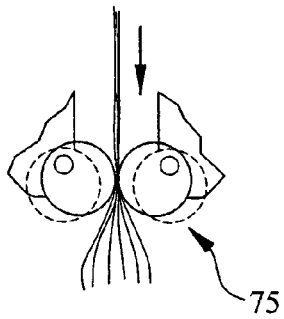
FIG. 10 is another embodiment of the braking mechanism of FIG. 7.

Hair coloring applicator 10 may also include a braking mechanism 75, as shown in FIGS. 7–10, for substantially preventing one or more strands of hair from passing in a backwards direction through hair channel 37 and possibly jamming hair coloring applicator 10. In at least one embodiment, braking mechanism 75 may be formed from one or more levers 76, as shown in FIG. 8. Lever 76 may be coupled to housing 24 proximate to outlet 41. This configuration allows hair to pass out of outlet 41, but prevents hair from traveling into the outlet, thereby preventing backwards flow. In another embodiment, braking mechanism 75 may be formed from an off-centered wheel, as shown in FIG. 7. The off-centered wheel operates much like lever 76 by preventing strands of hair from passing in a backwards direction through hair channel 37. In another embodiment, braking mechanism 75 may be formed from two juxtaposed levers having a channel passing between the levers, as shown in FIG. 9. In yet another embodiment, braking mechanism 75 may be formed from two wheels having a channel passing between the levers, as shown in FIG. 10. In yet another embodiment, braking mechanism 75 may be formed from ratcheted wheels. Braking mechanism 75 is not limited to these embodiments, but may include other mechanisms as well. In some embodiments, braking mechanism 75 may be used to impart a straightening action to the hair prior to coloring, particularly if the braking mechanism 75 includes wheels or rollers between which the hair can pass.

Figure 14:
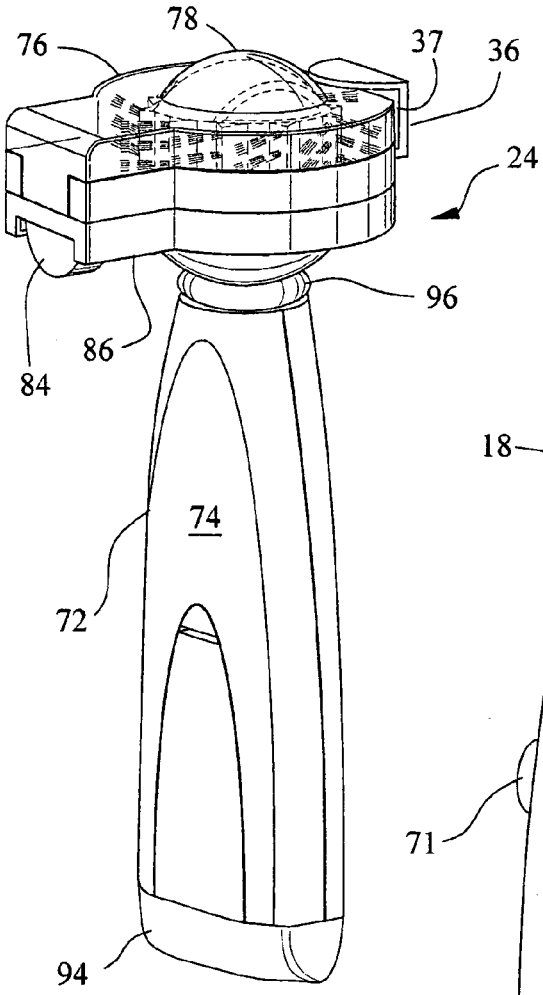
FIG. 14 is an assembled perspective view of the hair coloring applicator of FIG. 13.
Figure 15:
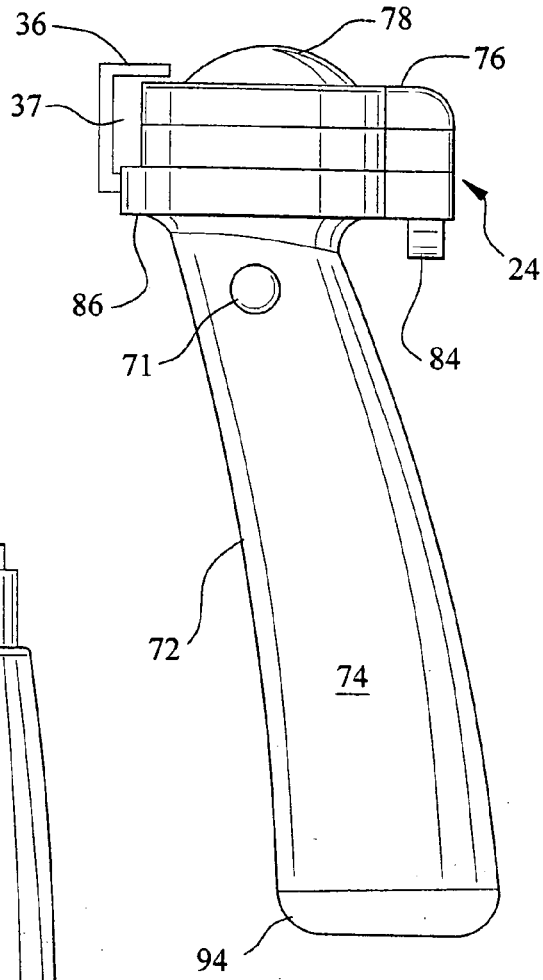
FIG. 15 is a side view of yet another embodiment of a hair coloring applicator.
Figure 16:
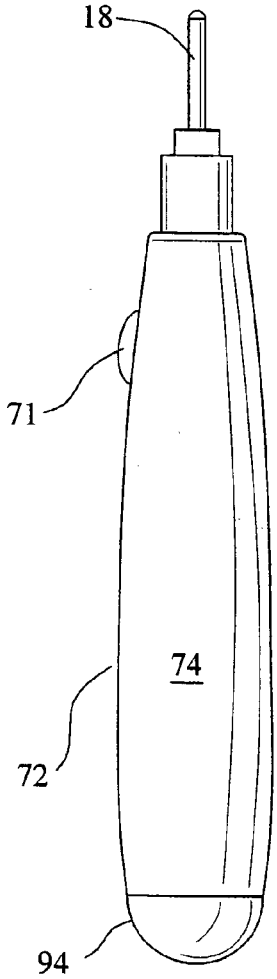
FIG. 16 is a partial front view of the embodiment shown in FIG. 15.

Hair coloring applicator 10 may be formed from another embodiment, as shown in an assembled view in FIG. 14–16 and in an exploded view in FIG. 13. In this embodiment, hair coloring applicator 10 may include many of the features previously described. Elements that differ from those elements described above are discussed in more detail below. For instance, housing 24 may configured to fit around a bottom portion of brush 12. Housing 24 may also include guides 46 for positioning one or more cartridges 42 in one or more positions. A cover 76 may be coupled to housing 24. Cover 76 may be pivotably coupled to housing 24 at posts 82. In one embodiment, cover 76 may include at least one viewing window 78 enabling a top surface 80 of brush 12 to be viewed through the cover. Viewing window 78 of cover 76 may be an aperture or may be formed from a relatively clear material. The top surface 80 of brush 12 may include graphical depictions, text messages, combinations thereof, or other visual objects. Top surface 80 may include advertisements, instructions, or warnings, in one or more languages.

Deflector 36 may be configured as describe above, but may also include retention mechanism 84. Deflector 36 may be configured to fit together with lower housing 86. Retention mechanism 84 may be sized and configured to fit in aperture 88. Aperture 88 may limit the distance of travel of retention mechanism 84 and thus deflector 36. Deflector 36 may be biased to a closed position using, for instance, a spring 89.

Handle 72 may be formed from one or more pieces, as shown in FIG. 13. For instance, handle 72 may be formed from at least three pieces; two halves 92 and a bottom member 94. Halves 92 and bottom member 94 may be assembled using screws, snap fittings, adhesives, or other mechanical connectors or chemical bonds or both. Handle 72 may have a curved configuration, as shown in FIG. 15. Body 16 may also include a ring 96 for retaining halves 92 together.

Figure 21:
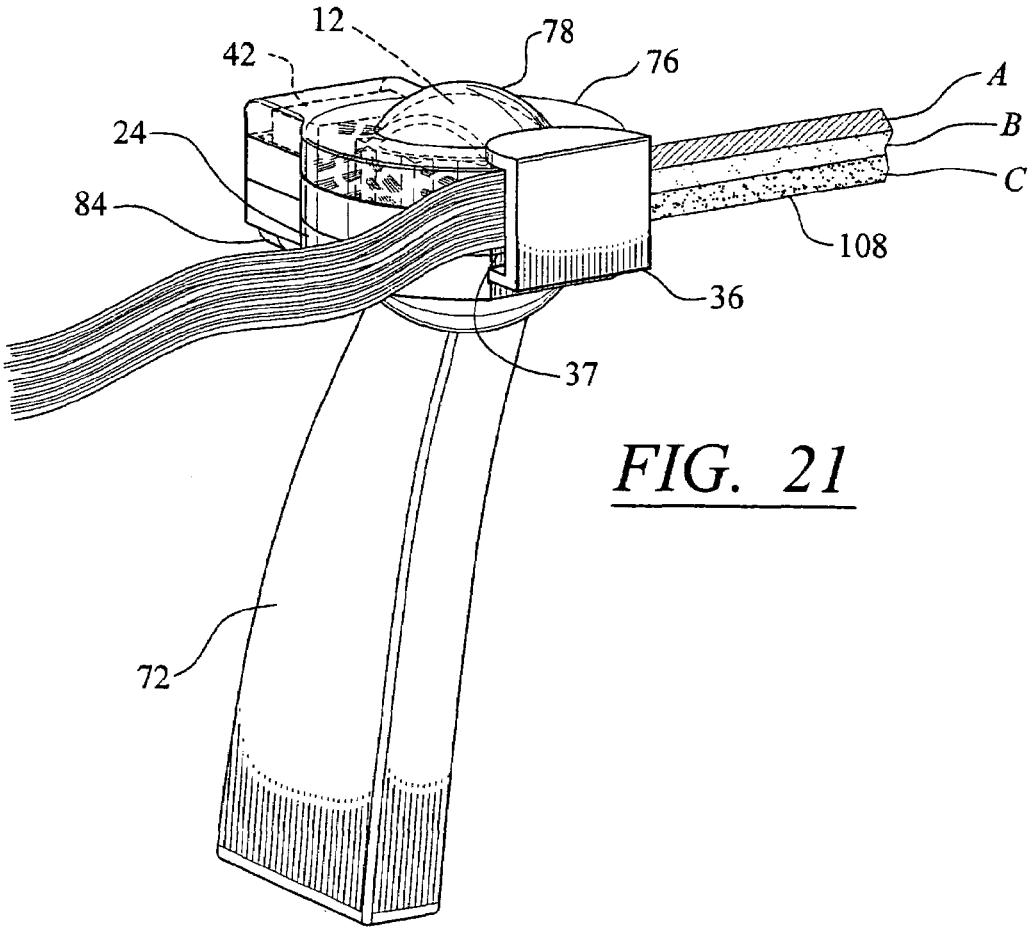
FIG. 21 is a perspective view of an embodiment of a hair coloring applicator with a collection of hair being colored with stripes.

The hair coloring applicator 10 may be used to apply one or more hair coloring materials 44 having one or more colors to strands of hair. In one embodiment, as shown in FIG. 21, the hair coloring applicator 10 may be used to form stripes 106 of colored hair 108 formed from colors A, B, and C. Hair coloring material 44 should be placed in a position to contact bristles 14 of brush 12. One or more strands of hair may be separated from other strands of hair. In one or more embodiments, a liquid may be applied to the collection of hair. The liquid may be water, hair spray, alcohol, any combination thereof, or other liquids capable of facilitating the transfer of hair coloring material 44 from bristles 14 to strands of hair. The liquid may be used to dissolve hair coloring material 44 when, for instance, the hair coloring material is in solid form, such as a powder.

Use of the liquid facilitates transfer of a hair coloring material 44 to strands of hair and may increase the aesthetic qualities of the strands of hair to which the hair coloring material has been applied. For instance, in one or more embodiments where hair coloring material 44 is a powder, the liquid may prevent strands of hair to which the hair coloring material has been applied from appearing chalky. The liquid may also include an adhesive, which may be a fixative, for adhering particles of hair coloring material 44 to strands of hair. The adhesive may be of varying strength. In at least one embodiment, the adhesive may keep the fixative adhered to strands of hair until the hair is washed.

One or more strands of hair may be placed in opening 28 of housing 24 so that the strands of hair feed into the opening, contact one or more bristles 14 of brush 12, and exit the opening. In embodiments having hair channel 37, one or more strands of hair may be placed in hair channel 37. While one or more strands or hair may be used in at least one embodiment, hair coloring applicator 10 may apply color to a collection of strands of hair that is about one inch wide by about 1/32 of an inch in thickness. The capacity of hair coloring applicator may vary and is not limited to this size collection of hair.

Figure 12:
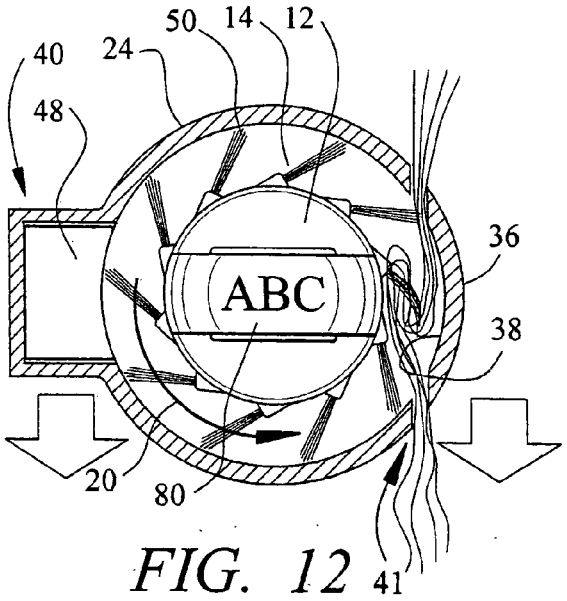
FIG. 12 depicts a possible result if hair is feed in a backwards direction into a hair coloring applicator.

Strands of hair may be placed into hair coloring applicator 10 while the applicator is proximate to a head, wig or other fixture holding the strands of hair to color substantially an entire length of the strands of hair. Alternatively, hair coloring applicator 10 may be positioned anywhere along the length of the strands of hair. To prevent the strands of hair from becoming entangled in the hair coloring applicator 10, as shown in FIG. 12, the strands of hair can be held taut by pulling on the free ends of the strands of hair not coupled to a head, wig, or another stationary device. In addition, a force may be applied to deflector 36 to press against the strands of hair and against bristles 14 to enhance the transportation of hair coloring material from the bristles to the hair and to prevent the strands of hair from moving outside of hair channel 37, thereby reducing the likelihood that strands of hair will be become entangled in brush 12. In one embodiment, this force is applied by a spring or other biasing mechanism.

Figure 11:
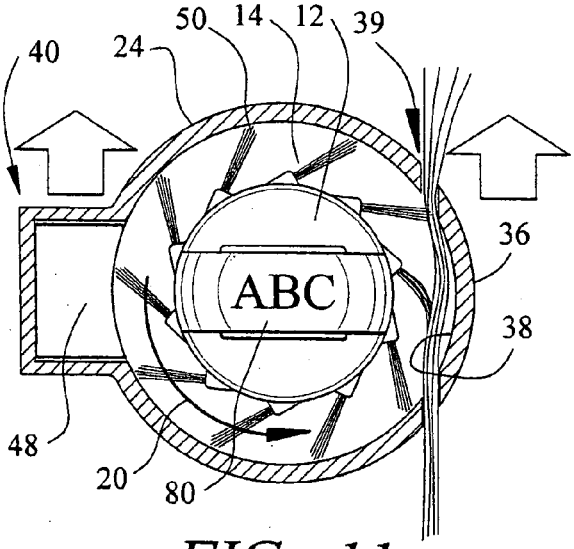
FIG. 11 depicts hair being fed into a hair coloring applicator.

Hair coloring applicator 10 may begin transferring hair coloring material from bristles 14 to strands of hair by rotating brush 12 while the strands of hair are in contact with the bristles. The brush 12 may be rotated using drive device 66, which may be motor 68, a crank, or other device. While using one or more embodiments containing motor 68, switch 71 may be actuated to control motor 68. Hair coloring applicator 10 may then be pulled in a direction that is generally away from a head, wig, or other device holding hair to prevent strands of hair from becoming tangled in the hair coloring applicator. As the hair coloring applicator 10 is pulled along the strand of hair, the hair is fed into the applicator 10 through inlet 39, as shown in FIG. 11. This causes the bristles 14, which rotate in the direction of arrow 20, to smoothly contact the strand of hair by brushing along the strand of hair and, in the case of real hair, in the direction of the hair cuticle. If the hair coloring applicator 10 is pulled such that hair is fed into the applicator 10 through outlet 41, as shown in FIG. 12, this can cause tangling of the hair because the tips of bristles 14 tend to push the strands of hair.

The brush 12 may be rotated continuously until hair coloring material has been applied to a desired portion of hair. If the embodiment being used contains a cartridge 42, the level of hair coloring material 44 should be monitored to ensure that the hair coloring material remains in contact with bristles 14. Cartridge 42 may be biased towards bristles 14, thereby eliminating the need for hair coloring material 44 to be monitored. However, in at least one embodiment, hair coloring material 44 of cartridge 42 may be kept in contact with bristles 14 using a manually actuated device, such as, but not limited to, a threaded rod, as shown in FIG. 17, springs 90, as shown in FIG. 18, a compressible material 101, such as foam, as shown in FIG. 19, guides 46, as shown in FIG. 20, or other devices.

Brush 12 may be removed from hair coloring applicator 10 to clean hair coloring material 44 from bristles 14. Brush 12 may be placed in a solvent or other material to remove hair coloring material 44. Brush 12 may be cleaned during use, such as when a different color of hair coloring material 44 is desired to be applied to strands of hair, or after use before hair coloring applicator 10 is stored. Brush 12 or tufts 13 also may be replaceable. In one embodiment, handle 72 may be detachable so that brush 12, housing 24, and other components may be cleaned without the possibility of damaging motor 68 contained in the handle while cleaning the brush.

Figure 27:
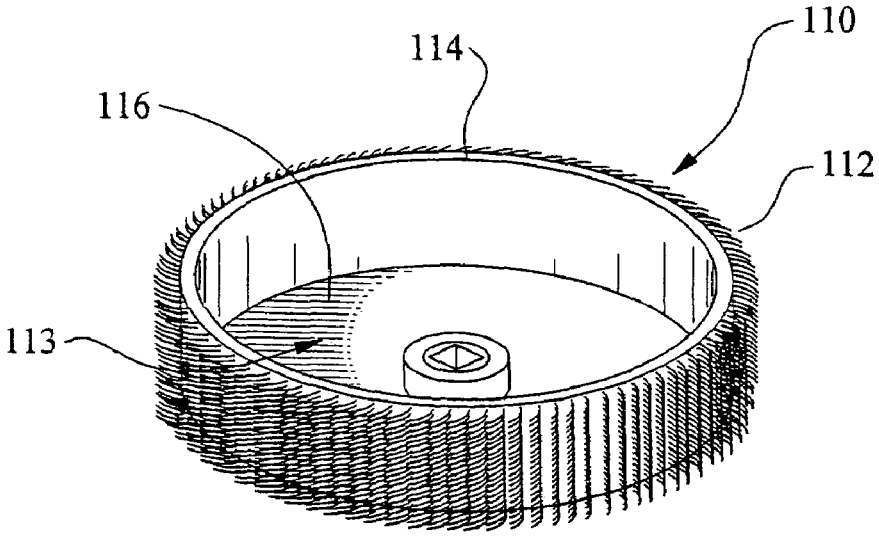
FIG. 27 is another embodiment of a brush of a hair coloring applicator.
Figure 28:
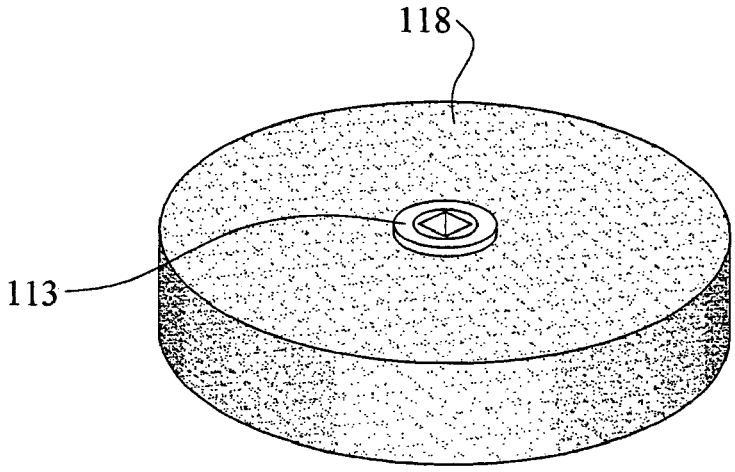
FIG. 28 is another embodiment of a brush of a hair coloring applicator.

FIG. 27 shows an alternative embodiment of hair coloring applicator, in which a brush 110 is generally annular and includes a napped material 112. The material 112 may be positioned on a rotatable support 113 including a mounting surface 114 that may extend all or partially around the circumference or perimeter of a hub 116 having a generally circular or other suitable cross-section. In an alternative arrangement, the brush 110 may include an absorbent material pad in place of the napped material 112. The absorbent material may be a foam or sponge material or any suitable material capable of absorbing hair coloring material from a holder and transporting it to the hair. In another arrangement, shown in FIG. 28, the support 113 is in the form of an axle, with an absorbent material 118 forming the body of the brush 110. The absorbent material 118 may be a foam or sponge material, or any other suitable material. The brush 110 of FIGS. 27 and 28 may be used in the housing 24 in place of the brush 12 described in relation to FIGS. 1 to 24.

Figure 26:
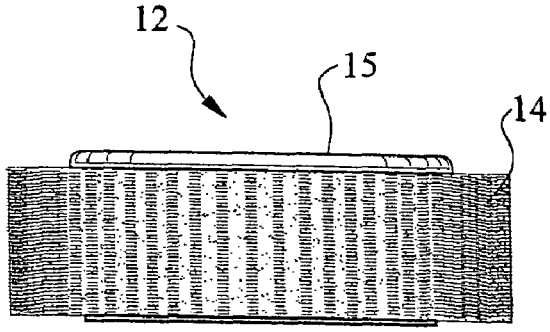
FIG. 26 is a side view of the brush of FIG. 25.
Figure 29:
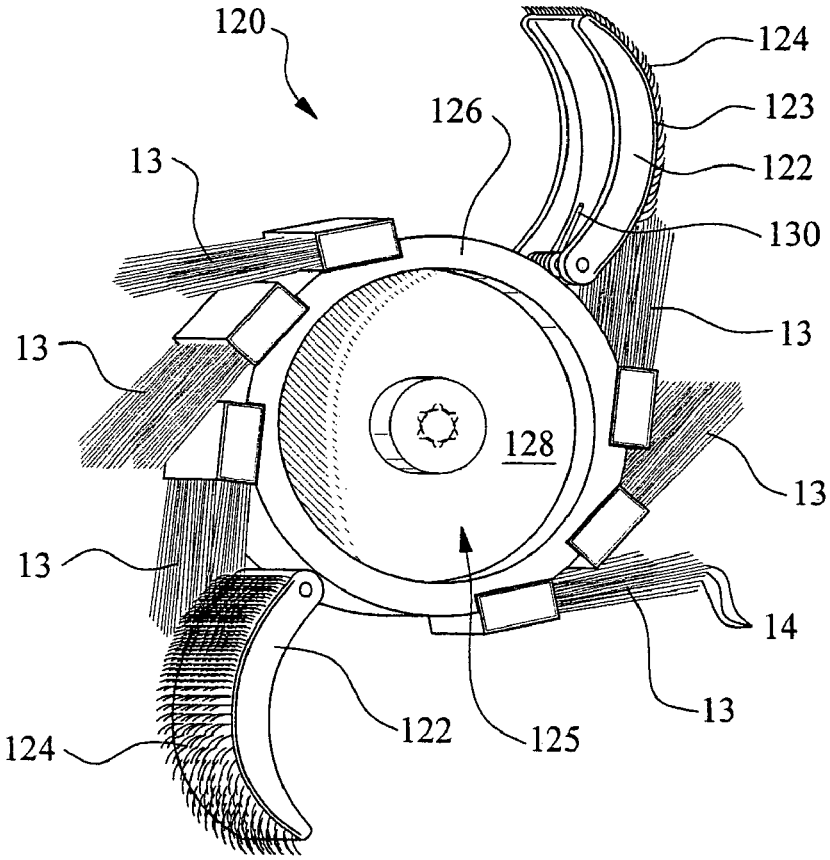
FIG. 29 is a further embodiment of a brush of a hair coloring applicator.
Figure 30:
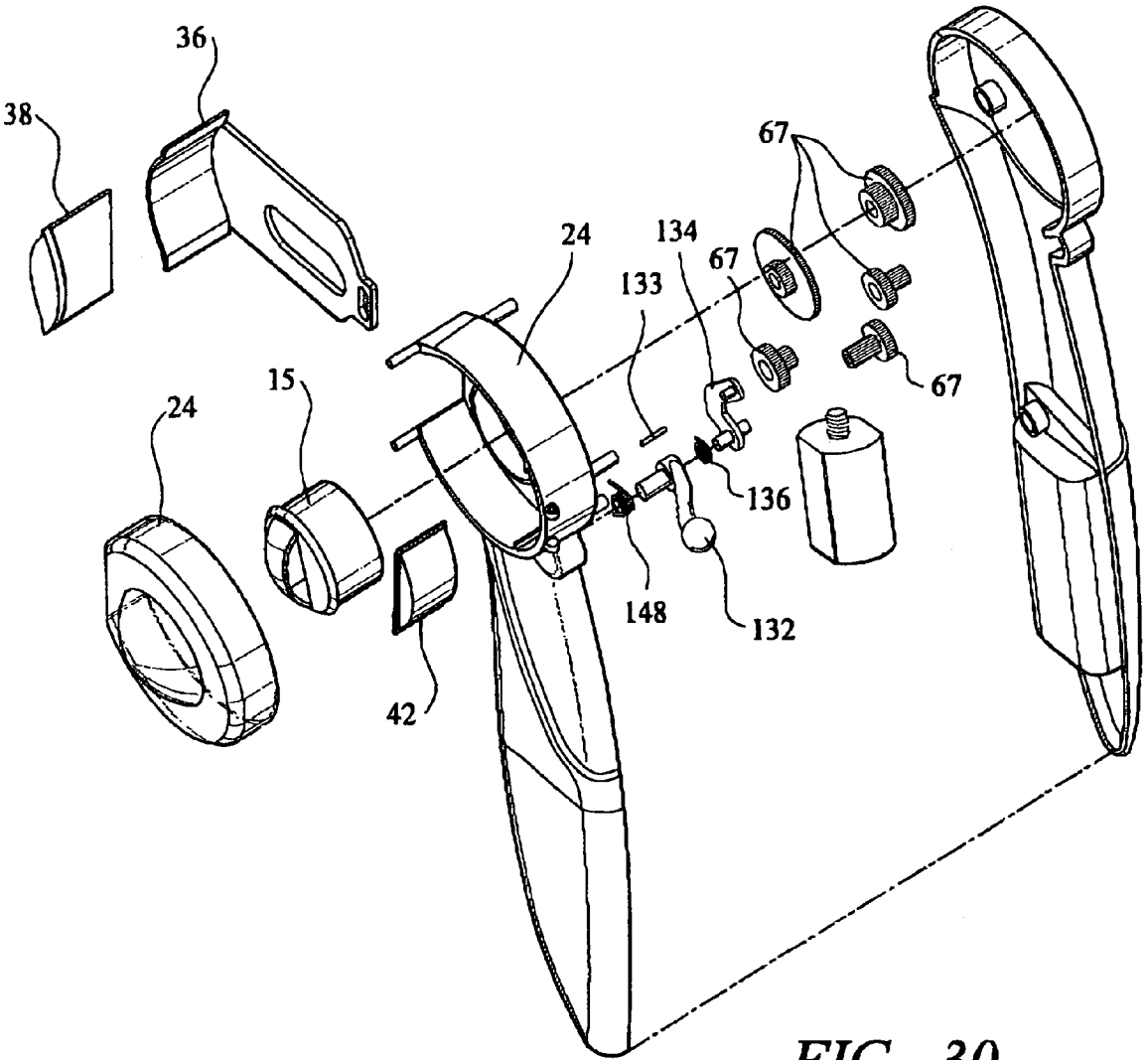
FIG. 30 is an exploded perspective view of another embodiment of a hair coloring applicator.
Figure 31:
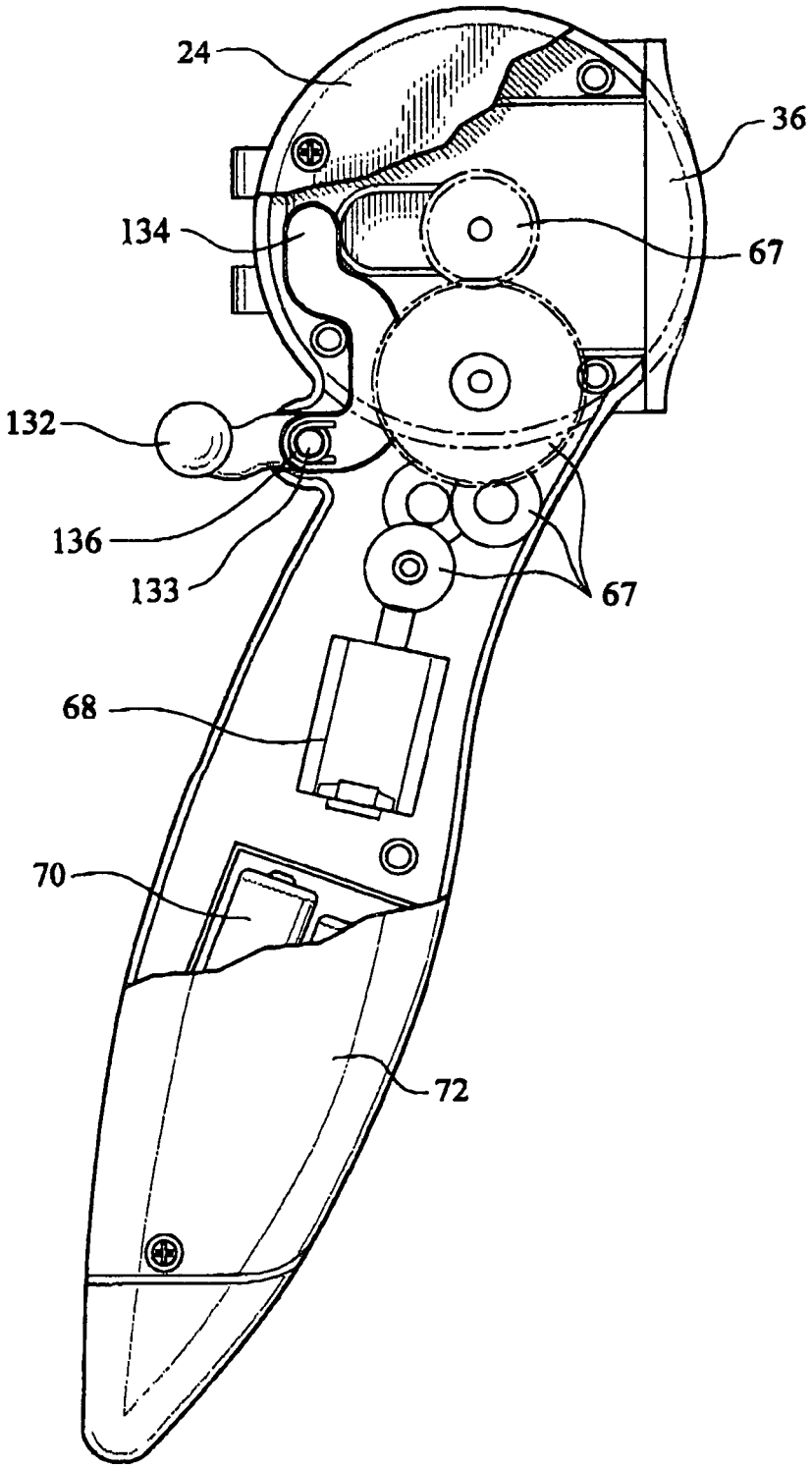
FIG. 31 is a side part-sectional view of the applicator of FIG. 30.
Figure 32:
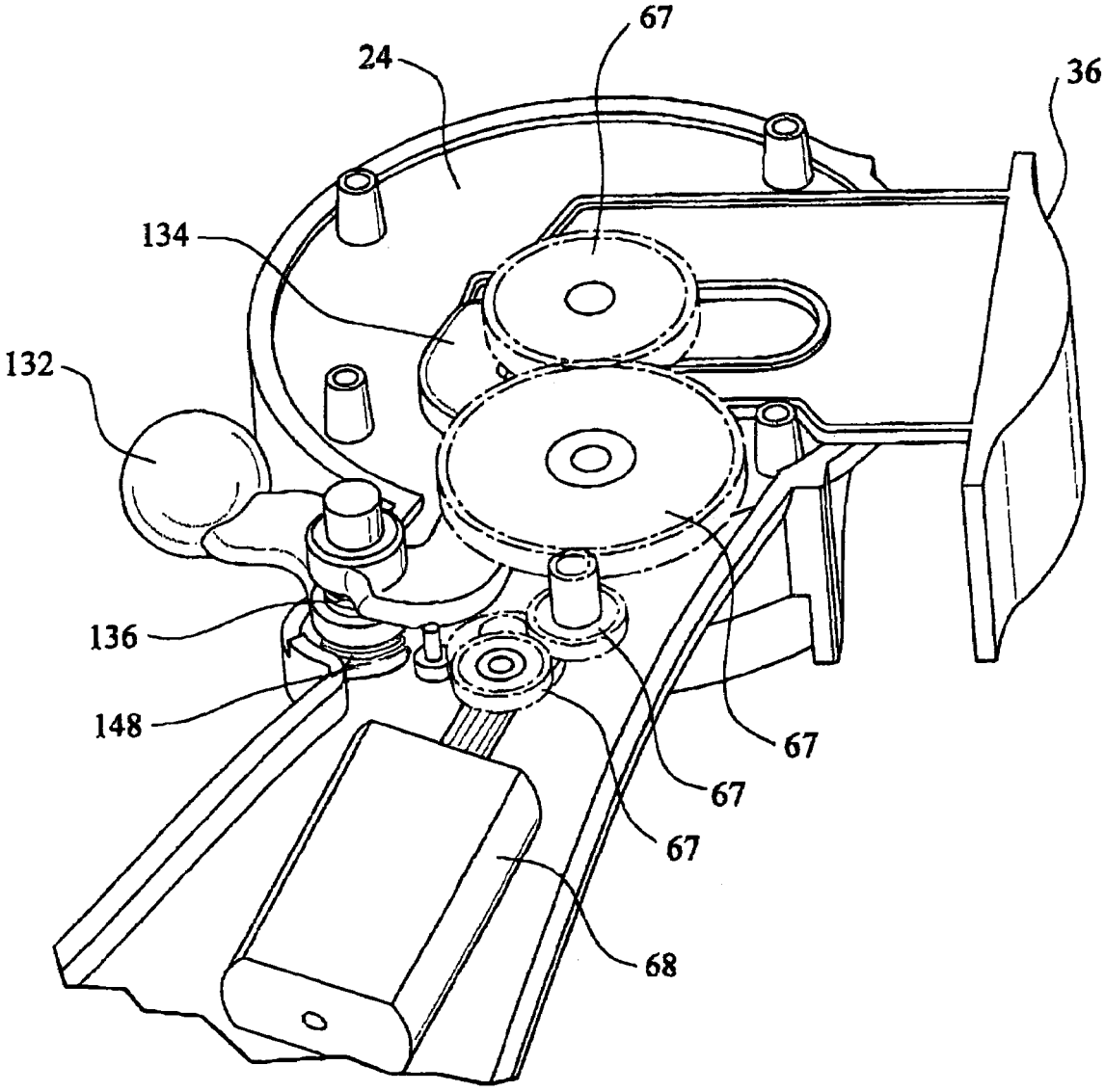
FIG. 32 is a perspective view of a deflector and operating mechanism.
Figure 33:
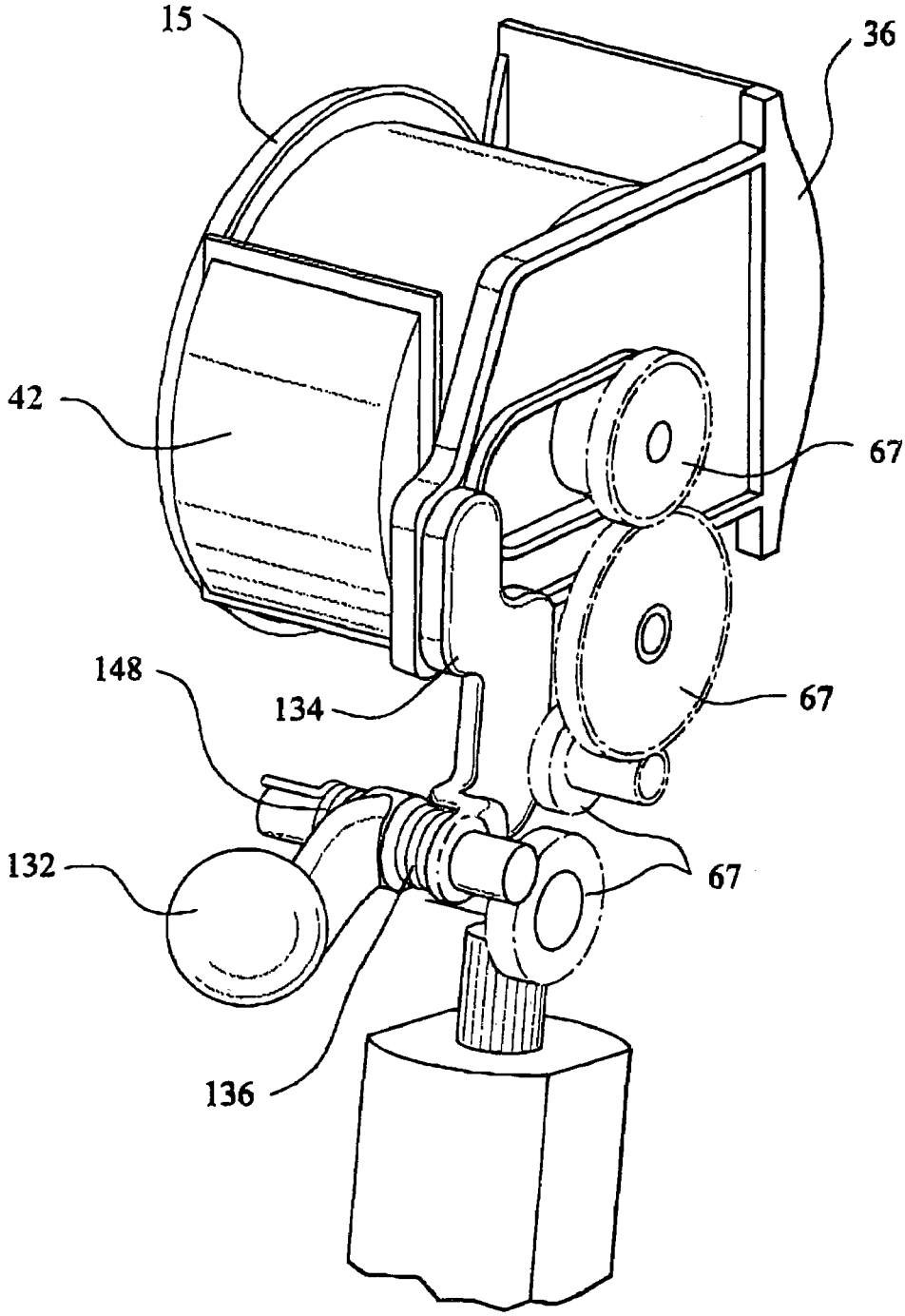
FIG. 33 is a perspective view of the mechanism of FIG. 32, in an opened position.
Figure 34:
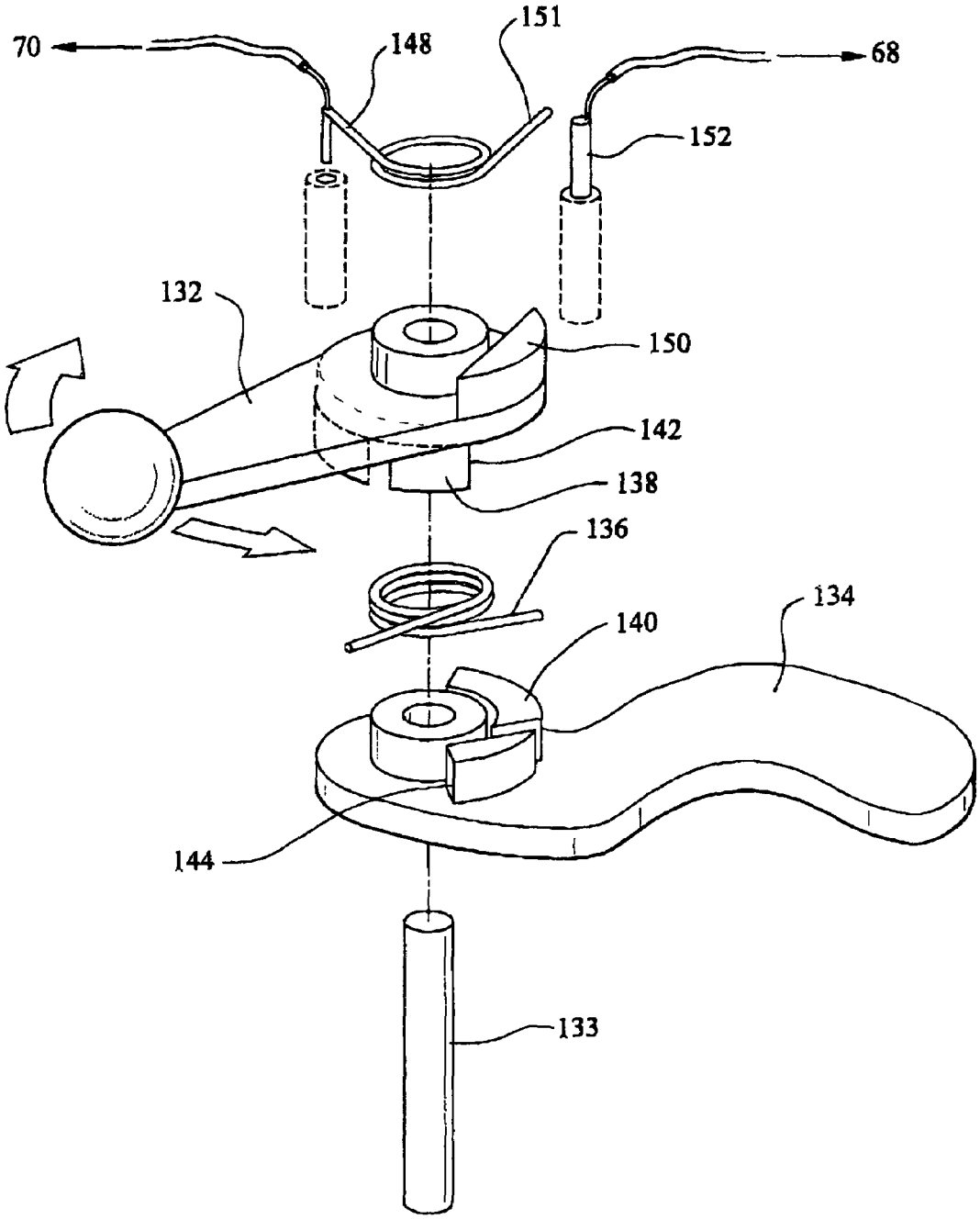
FIG. 34 is an exploded perspective view of the operating mechanism of FIG. 32.

FIG. 29 shows a further embodiment of hair coloring applicator, in which a brush 120 includes two movable brush elements 122. The brush elements 122 each include a mounting surface 123 having a napped or absorbent material 124 or any other suitable material placed thereon. The brush elements 122 are mounted onto a rotatable support 125 including a mounting surface 126 provided around the circumference or perimeter of a hub 128 which may have a generally circular or other suitable cross-section. The brush elements 122 may be spring-loaded with a spring 130 such that they are typically biased into an extended position, as shown in FIG. 26. One or more bristle tufts 13 may also be provided around the circumference or perimeter of the brush 120, in a similar manner to the embodiments described in relation to FIGS. 1–24. In the illustrated embodiment, three tufts 13 are placed between each brush element 122, although it will be appreciated that the invention is not limited in this regard. In some embodiments, a plurality of brush elements 122 may be provided, spaced equidistant around the circumference or perimeter of the brush 120, with no bristles or tufts provided therebetween. For example, four, six or eight brush elements 122 may be used in some embodiments. The brush 120 may be used in place of the brush 12 in the housing 24, and may be rotatably mounted with respect to the housing. The springs 130 act to bias the brush elements 122 outwardly away from mounting surface 126, into contact with the hair coloring material 44 provided in the housing 24 even as the coloring material is depleted in use, and also into contact with the hair.

In a further alternative embodiment of hair applicator 10, shown in FIGS. 30–34, the brush 12 is aligned with the handle 72, in a similar manner to the embodiments shown in FIGS. 1–6. In this embodiment, hair coloring applicator 10 may include many of the features previously described. The bristles 14 of brush 12 are not shown in FIGS. 30–33 for ease of illustration. Certain elements that differ from those elements described above are shown in the drawings and/or discussed in more detail below.

The deflector 36 and the motor 68 may be operated by a single operating lever 132. The operating lever 132 may be pivotally connected via an axle 133 to a crank 134 that operates the deflector 36. A spring 136 or other suitable biasing mechanism may also be provided between operating lever 132 and crank 134. Complementary bosses 138 and 140 may be provided on ends of lever 132 and crank 134, respectively, to retain the spring 136 in position. The bosses 138 and 140 may include aligned stops 142 and 144 that allow the operating lever 132 to move crank 134. A spring 148 or other suitable biasing mechanism may also be connected to the operating lever 132, and may be located on an opposite side of operating lever 132 to the spring 136. The spring 148 may be of weaker strength than the spring 136. A boss 150 may be included on an end of lever 132 to retain the spring 148 in position.

The operating lever 132 may be pushed away from a neutral position, causing the lever 132 and crank 134 to act together through stops 142 and 144 to open the deflector 36 in order to receive a strand or strands of hair. The movement of the lever 132 in the deflector opening direction does not affect the spring 136, but winds spring 148 sufficiently such that, upon release of the lever 132, the spring 148 may unwind. Unwinding of the spring 148 biases the operating lever 132 back into the neutral position and closes the deflector 36.

From the neutral position, the operating lever 132 may be pulled or pushed in an alternate direction to the direction that opens the deflector 36, against the force of the spring 136. This movement may cause the spring 136 to wind. The movement of the operating lever 132 may move an end 151 of the spring 148 to make an electrical connection with a contact 152 of the motor 68 in order to operate the motor 68. Upon release of the lever 132, the spring 136 may unwind, biasing the lever 132 toward the neutral position. The operating lever 132 is thus biased into the neutral position between the actions of the two springs 136 and 148, and the springs 136 and 148 ensure that the motor 68 is only operable with the deflector 36 held closed.

The foregoing is provided for purposes of illustrating, explaining, and describing embodiments of this invention. Modifications and adaptations to these embodiments will be apparent to those skilled in the art and may be made without departing from the scope or spirit of this invention.

The invention claimed is:

1. A hair coloring applicator, comprising:

a housing;

a brush, wherein the brush rotates relative to the housing;

a hair coloring material holder, wherein the holder is positioned such that hair coloring material held by the holder can contact the brush; and a deflector movably coupled to the housing for placing at least one strand of hair in contact with the brush, wherein the housing includes at least one opening for receiving at least one strand of hair and placing the at least one strand of hair in contact with the brush.

2. The hair coloring applicator of claim 1, wherein the brush is generally annular.

3. The hair coloring applicator of claim 1, wherein the brush comprises a support and at least one of the group consisting of bristles, napped material and absorbent material arranged on the support.

4. The hair coloring applicator of claim 1, wherein the brush comprises a support and at least one of the group consisting of bristles and napped material arranged on an outer surface of the support, and wherein the bristle or nap of the brush is angled away from a direction of rotation of the brush.

5. The hair coloring applicator of claim 2, wherein the brush comprises a support and at least one brush element mounted to the support, and a biasing mechanism that biases the at least one brush element away from the support into contact with hair coloring material held by the holder.

6. The hair coloring applicator of claim 5, comprising at least two said brush elements mounted to the support.

7. The hair coloring applicator of claim 5, wherein the at least one brush element includes a mounting surface movable relative to the support, and the at least one brush element comprises at least one of the group of napped material and absorbent material provided on the mounting surface.

8. The hair coloring applicator of claim 1, wherein the holder for hair coloring material is provided at a first location relative to the housing, the applicator further comprising:

a motor having a shaft, the brush being driven rotationally in response to rotation of the shaft; and a deflector movably coupled relative to the housing at a second location which is spaced from the first location so as to contact the brush at the second location, the deflector defining a hair channel in the housing at the second location between an inlet into the housing and an outlet from the housing, whereby rotation of the brush causes hair coloring material from a supply held in the holder at the first location to be transferred to any hair disposed in the hair channel at the second location.

9. The hair coloring applicator of claim 1, further comprising at least one device that applies a hair coloring material to the brush.

10. The hair coloring applicator of claim 9, further comprising a biasing mechanism that biases a hair coloring material dispensing cartridge positioned in the hair coloring material holder towards the brush to keep a hair coloring material contained in the hair coloring material dispensing cartridge in contact with the brush.

11. The hair coloring applicator of claim 10, wherein the biasing mechanism comprises a spring.

12. The hair coloring applicator of claim 10, wherein the biasing mechanism comprises a threaded rod.

13. The hair coloring applicator of claim 10, wherein the biasing mechanism comprises a compressible material.

14. The hair coloring applicator of claim 9, wherein the at least one device that applies a hair coloring material to the brush comprises a plurality of guides that position a hair coloring material dispensing cartridge so tat the brush contacts the hair coloring material contained in the hair coloring material dispensing cartridge.

15. The hair coloring applicator of claim 9, wherein the at least one device that applies a hair coloring material to the brush comprises at least one aperture in the housing for receiving a hair coloring material and allowing the hair coloring material to contact the brush.

16. The hair coloring applicator of claim 15, further comprising a flange coupled to the housing proximate to the aperture and configured to support a container capable of storing hair coloring material.

17. The hair coloring applicator of claim 1, wherein the deflector comprises a substantially flat inside surface.

18. The hair coloring applicator of claim 1, wherein the deflector is biased toward the brush.

19. The hair coloring applicator of claim 1, further comprising an operating mechanism that operates hot the deflector and a motor that drives the brush.

20. The hair coloring applicator of claim 19, wherein the operating mechanism is biased to a position whereby the deflector is closed and the motor is off.

21. The hair coloring applicator of claim 1, further comprising a motor having a shaft that rotates the brush.

22. The hair coloring applicator of claim 21, further comprising a gear assembly configured to couple the shaft of the motor to the brush.

23. The hair coloring applicator of claim 21, further comprising a power source.

24. The hair coloring applicator of claim 23, wherein the power source is at least one battery.

25. The hair coloring applicator of claim 1, wherein the hair coloring material holder comprises a container releasably coupled to the housing.

26. The hair coloring applicator of claim 25, wherein the container is squeezable.

27. The hair coloring applicator of claim 25, further comprising a plunger.

28. The hair coloring applicator of claim 1, further comprising a braking mechanism that substantially prevents the at least one strand of hair from traveling backwards through the at least one opening.

29. The hair coloring applicator of claim 28, wherein the braking mechanism comprises at least one lever arm coupled to the housing.

30. The hair coloring applicator of claim 28, wherein the braking mechanism comprises at least one off-centered wheel.

31. The hair coloring applicator of claim 28, wherein the braking mechanism comprises at least two juxtaposed wheels.

32. The hair coloring applicator of claim 1, wherein the brush is rotatably mounted in the housing.

33. The hair coloring applicator of claim 1, wherein the brush is seated within the housing below a cover.

34. The hair coloring applicator of claim 1, wherein the hair coloring material holder is positioned such that hair coloring material held by the holder can contact the brush within the housing.

* * * * *